United States Patent [19]

Logus

[11] 4,328,954

[45] May 11, 1982

[54] WINCH WITH COMPACT, HIGH EFFICIENCY AND HIGH RATIO GEARING SUITABLE FOR FREE FALL

[75] Inventor: Anthony T. Logus, Elmwood Park, Ill.

[73] Assignee: Pettibone Corporation, Chicago, Ill.

[21] Appl. No.: 36,865

[22] Filed: May 7, 1979

[51] Int. Cl.[3] ..... B66D 1/08; B66D 1/22

[52] U.S. Cl. ..... 254/344; 74/781 R; 192/8 R; 192/18 A

[58] Field of Search ..... 254/344, 346, 347, 349, 254/356, 361, 365–367, 297, 300, 303, 310, 315, 345, 355, 357, 368; 192/18 A, 8 R, 8 A; 74/781 R, 784

[56] References Cited

U.S. PATENT DOCUMENTS

| | | | |
|---|---|---|---|
| 2,351,654 | 6/1944 | Anderson | 254/344 |
| 3,370,832 | 2/1968 | Spyridakis | 254/344 |
| 3,519,247 | 7/1970 | Christison | 254/344 |
| 4,090,693 | 5/1978 | Hoehn et al. | 254/347 |
| 4,118,013 | 10/1978 | Christison et al. | 254/347 X |
| 4,161,126 | 7/1979 | Winzeler | 254/344 X |
| 4,185,520 | 1/1980 | Henneman et al. | 254/344 X |

*Primary Examiner*—John M. Jillions
*Attorney, Agent, or Firm*—Louis Robertson

[57] ABSTRACT

The drum of a winch suitable for cranes is driven by gearing compactly arranged within the drum, leaving room also for a free fall dog clutch when desired. The gearing is of the compound planetary type which can provide very high ratios with low friction. The low friction yields greater efficiency, and permits retaining the gearing in operation idly during free fall, ready for fail-safe braking using it. A separate brake is provided for stopping free fall, when free fall is provided. The winch motor is preferably of the two unit type, with valving for two speeds. Operation of either manual valve (normal operation or free fall) from its neutral position neutralizes the other. Numerous automatic valves are included in a valving block, providing simplicity of piping.

6 Claims, 7 Drawing Figures

FIG. 2
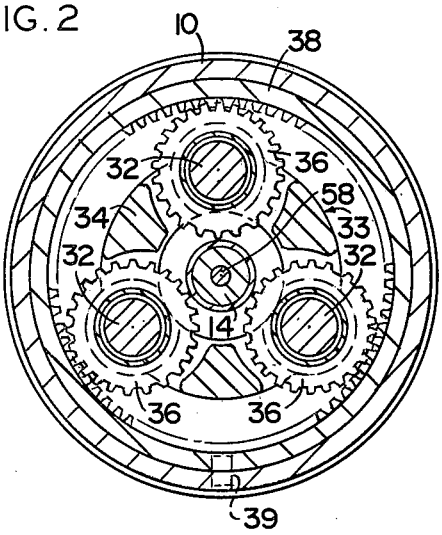
FIG. 3
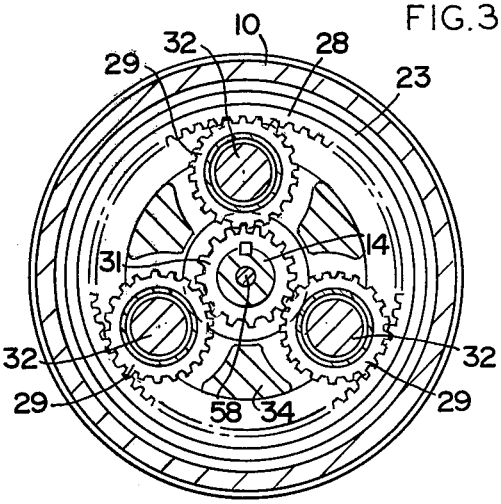
FIG. 4
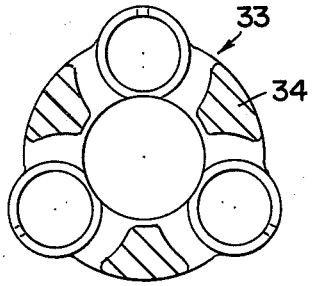
FIG. 5
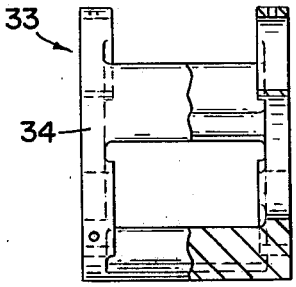
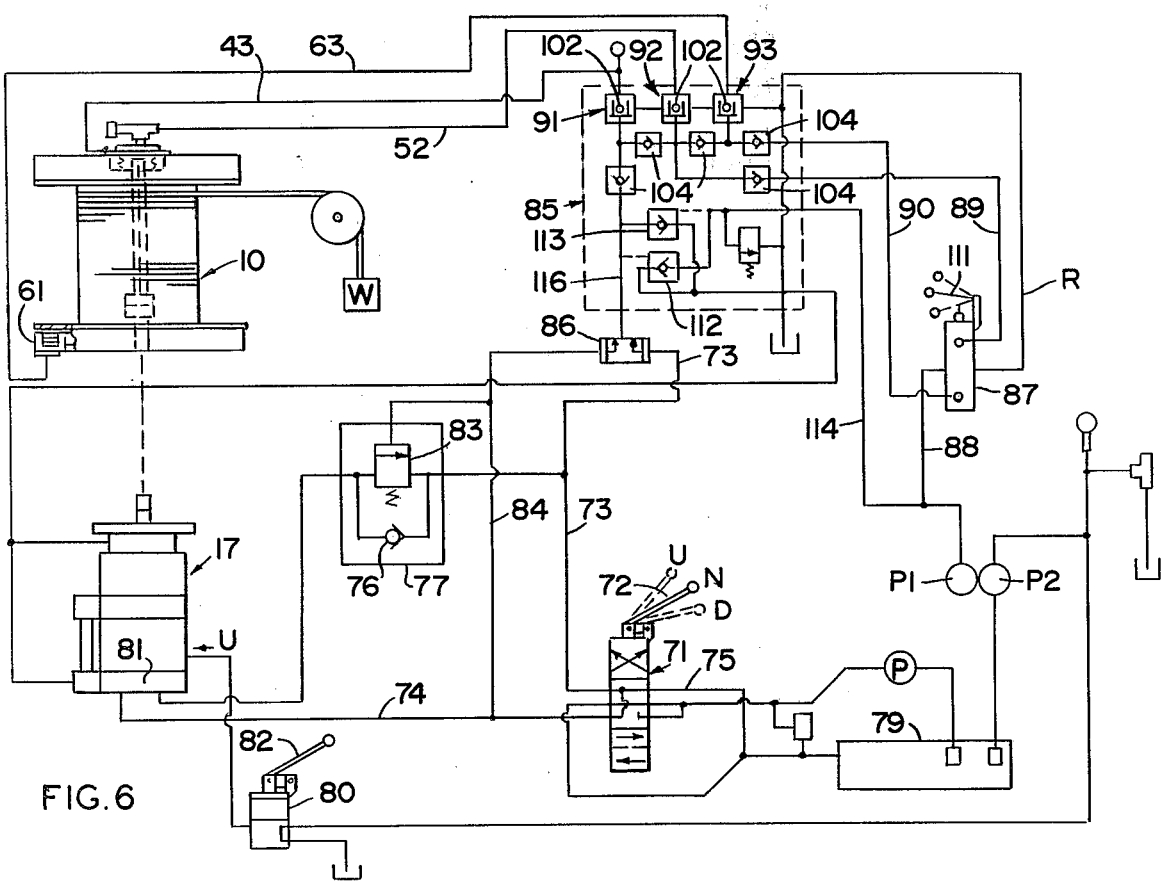
FIG. 6

WINCH WITH COMPACT, HIGH EFFICIENCY AND HIGH RATIO GEARING SUITABLE FOR FREE FALL

INTRODUCTION

The invention of which the present disclosure is offered for public dissemination in the event that adequate patent protection is available relates to winches such as are used in cranes, and more particularly to the drive and braking for the winch drum. Such drives need high ratio gearing, which tends to be bulky and to have high friction. The high friction wastes power and capacity and tends to exclude the use of free fall. Free fall is one method of speeding overall operations. For example, a bucket filled with concrete must be raised slowly, but if, after the concrete has been dumped, the bucket can be dropped at high speed, it is more quickly ready for lifting another load, especially when a high structure is being erected. By "free fall" is meant that the load suspended by a line is permitted to pull out the line and unwind it from the winch with relative freedom so that the load can be lowered more rapidly than it could be lowered by driving the winch in the paying-out direction by its hydraulic motor. Even if a two speed hydraulic motor is provided, its higher speed will be considerably slower than free fall.

Cranes are required to have fail-safe braking. It is advantageous to apply the braking on the power-input side of the high ratio gearing so that the torque at the brake is lowered by the high ratio. This necessitates keeping the gearing in operation, idly, during free fall; but past high ratio gearing used in cranes has been unsuitable for this because of high friction characteristics. For example, higher ratios of worm gearing, popular for cranes, is fully self-locking against hoist-line pull out. With two-stage gearing, also popular, all of the friction of the primary stage resists hoist-line pull out with a torque multiplied by the ratio of the second stage.

According to the present invention, a single stage of compound planetary high ratio gearing is used. Although it has two sets of planetary gears, the two sets are coupled and produce the high ratio as a unit. The only gear whose friction is multiplied during free fall by the high ratio is the sun gear. During free fall, this spins freely with very little friction. During drive by the sun gear, friction is also quite low, permitting maximum use of the power available. Because free fall does not require disconnect between the gearing and the drum, the fail-safe brake can be on the sun gear side of the gearing where it takes advantage of the high ratio. This gearing is so compact that it, and the clutch system for disconnect from the motor for free fall, can be housed within a drum suitable for long-line hoisting operations.

Even when free fall is not desired by the customer, and is not provided, this gearing is quite advantageous for its other characteristics mentioned. From the standpoint of manufacturing and servicing it is also highly desirable to use on the entire line of cranes the same gearing that is needed when free fall is desired by a customer.

When free fall is provided, a manually controlled valve separate from the manually controlled valve which operates the motor for normal operations is preferred. Mistakes to which this could lead are avoided by having operation of either manual valve from its spring-loaded neutral position neutralize the other. The complex automatic valving which this requires is provided without great complexity of piping by a newly designed multiple-valve block.

The advantages of the invention may be more apparent from the following description and from the drawings.

DESIGNATION OF FIGURES

FIG. 1 is an axial sectional view through a preferred form of winch chosen for illustration of the present invention, and including free fall.

FIGS. 2 and 3 are radial sectional views taken approximately along the lines 2—2 and 3—3, respectively of FIG. 1 to show especially the two planetary systems.

FIGS. 4 and 5 are detail views showing the planetary cage more clearly than in FIGS. 1 to 3.

FIG. 6 is an illustrative and schematic diagram of a preferred hydraulic system for use when free fall is provided.

DESCRIPTION OF EXAMPLE EMBODYING BEST MODE OF THE INVENTION

Figure 1:
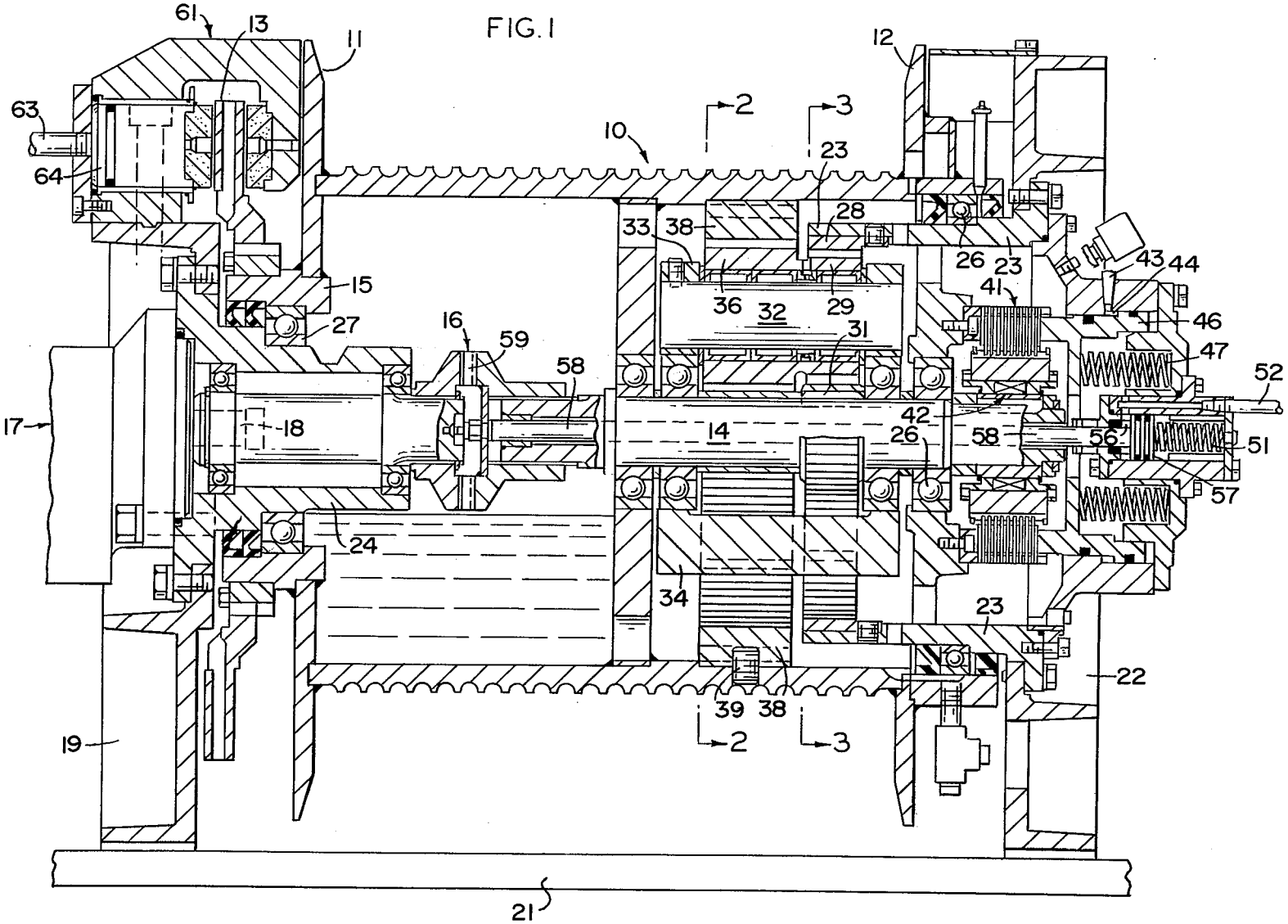

The winch for the illustrated form of the invention includes a drum 10 on which the line, usually a hoist-line of a crane, would be wound between its end disks 11 and 12. The disk 11 may have a free fall brake disk 13, splined to its hub 15, if the free fall option is provided.

The drum 10 is driven, through gearing, to be described as a main feature of this invention, by a shaft 14. Shaft 14 is in turn driven by hydraulic motor 17 (through free fall dog clutch 16 if free fall is provided). The output shaft of motor 17 is shaft 18. The hydraulic motor 17 is carried by stanchion 19 rigidly secured to base 21. The base 21, unless a part of the associated equipment, would be a plate by which the winch is secured to the crane or other equipment with which the winch is to be used. The base 21 also carries the opposite stanchion 22. The stanchion 22 has fixed thereto an inwardly extending tubular bearing holder or hub 23. Stanchion 19 similarly is provided with a rigidly secured inwardly extending bearing holder or hub 24. Bearing assemblies 26 and 27 are carried respectively by the holders 23 and 24 for rotatively supporting the drum 10.

Compound Planetary Gearing

The inner end of hub 23 carries an inwardly-toothed ring gear 28. This is a stationary ring gear (locked to hub 23) with which, as best seen in FIG. 3, three planetary gears 29 mesh. As seen in FIG. 3, the three planetary gears 29 also mesh with pinion or sun gear 31, keyed to shaft 14. It is apparent from FIG. 3 that as shaft 14 is driven (by motor 17, FIG. 1) its sun gear 31 will drive planetary gears 29 so that they move themselves along fixed ring gear 28, orbiting in the same rotary direction that shaft 14 turns.

Each of the planetary gears 29 is carried, through a bearing assembly, by a pin or shaft 32 forming part of cage 33. Cage 33 includes a machined casting 34, seen in FIGS. 4 and 5, in which the pins 32 are mounted in the course of assembling the total planetary structure comprising casting 34, pins 32, planetary gears 29 and their bearings.

Looking at FIG. 1 it will be apparent that as planetary gears 29 are revolved in their planetary orbits, their companion planetary gears 36, on the same orbiting shafts 32, will likewise rotate in orbit. Inasmuch as the campanion planetary gears 29 and 36 of each companion pair are formed of a single piece, it is apparent that correlated to their orbital rotation is a rotation about their common shaft 32, providing compound planetary gearing. This is a single-stage gearing to be distinguished from two-stage planetary gearing which is well known for crane winches, but less advantageous.

Planetary gears 36, as seen in FIG. 2, mesh with a ring gear 38 carried by drum 10 and keyed to rotate with it as indicated at 39. From FIG. 1 it may be apparent that if the two planetary gears 29 and 36 had the same radius, the ring gear 38 and drum 10 would remain stationary during orbital rotation of the planetary gears, because the two companion planetary gears would rotate alike on both of their associated ring gears, 28 and 38. Accordingly, a slight departure from having the same radius causes a slight rotation of ring gear 38 and drum 10. The gear ratio of the gearing therefore depends upon the closeness of the radii of the two planetary gears 29 and 36. In spite of the compactness, a very high gear ratio can easily be provided. Nevertheless, the gearing is not self locking in the sense that a high-ratio worm gear would be, and hence this gearing lends itself to use in a winch which may be provided with free fall characteristics.

Fail-Safe Braking At Low Torque

The gearing also lends itself to cooperation with the required "fail-safe" facilities and using the high ratio of the gearing to reduce the torque of braking. If the shaft 14 is held from rotation, the companion planetary gears 29 and 36 cannot rotate, and hence they lock ring gear 38 to stationary ring gear 28, and the drum 10 cannot rotate. Shaft 14 is normally prevented from rotation in the direction which would let the load down, by "fail-safe" disk brake assembly 41. Springs 47 bias this assembly to effectuate braking action. An over-running clutch assembly 42 would permit shaft 14 to be driven in the opposite direction, for raising the load, even if disk brake assembly 41 remained firmly set.

When the load is to be lowered by driving the hydraulic motor 17, pressured hydraulic fluid is supplied not only to hydraulic motor 17 but also to tube 43 which communicates with expansion chamber 44 to move brake piston 46 in the brake release direction, compressing springs 47. Whenever the hydraulic pressure being supplied to tube 43 is released, intentionally or by accident, springs 47 actuate the piston in the brake-applying direction with sufficient force (multiplied by the gearing ratio) to hold any load that could have been lifted. To ensure dependability of this brake, it should not be used for stopping free fall.

Free Fall Option

If free fall is to be provided, a separate readily accessible brake 61 and its disk 13 are provided. The brake assembly 41 must be released throughout free fall operation, and this is done by again supplying hydraulic pressure to tube 43. In addition, the shaft 14 must be released from the hydraulic motor 17. This is accomplished by the free fall clutch 16 which is a dog type of clutch illustrated as biased by spring 51 to the engaged position. For releasing clutch 16 when free fall is to be used pressure fluid is supplied to tube 52 to flow into expansion chamber 56, where it overcomes the force of biasing springs 51, moving the piston 57, and actuator rod 58, and by them actuating dogs 59, to the disengaged position. Escape of fluid past piston 57 or along rod 58 is preferably prevented by a tandem set of chevron seal rings at each location.

It is of course necessary to be able to hold or stop the load when "free fall" is the chosen way of lowering the load. It is desirable that the brake for this purpose have smooth-applying characteristics and be reasonably accessible for replacement of its friction elements. Such a brake is shown at the left in FIG. 1, in the form of a caliper brake 61 operating on disk 13, which is keyed to hub 15 of drum disk 11. For applying the free fall brake, pressured hydraulic fluid is applied to tube 63 which communicates with the inside of brake cylinder 64. Present plans are for three such brake cylinders, all supplied from tube 63, along a shoe extending along a peripheral zone of disk 13. Brake disk 13 is free to slide axially on splines so that it tends to center itself to be squeezed between two brake shoes bearing equally on opposite faces. Radial channels through disk 13 provide its own air cooling while it spins, to dissipate heat developed as heavy loads are stopped.

Hydraulic System

Much of the hydraulic system shown in FIG. 6 is conventional. Thus, a main control valve 71 is a conventional reversing valve operated by a manual lever 72. It is illustrated as in its neutral (middle position) to which it is spring-loaded, with both output or "cylinder" ports connected to return line 75. Depending on which way it is moved, it supplies fluid pressure from pump P either to the raising line 73 or to the lowering line 74, simultaneously connecting the other for discharge to return line 75. Fluid supplied to line 73 can pass through the check valve 76. This may be part of a safety valve 77, sometimes called a counterbalance valve. Thus, the fluid can flow through raising line 73, through the hydraulic motor 17 to drive it, and then return through line 74 and through the control valve 71 to the return line 75 and reservoir 79. Preferably, as illustrated, the hydraulic motor 17 has two motor units which can be connected either in series or in parallel by a speed control valve at 81 in motor assembly 17. It is controlled by a remote control valve 80, actuated by its lever 82 and receiving hydraulic pressure from pump $P_2$. Main pump P supplies fluid for motor 17, usually at a constant rate of flow. The same flow of fluid will drive motor 17 at half the speed and with twice the available torque if the motor units are connected in parallel, as compared to the same motor with its motor units connected in series. Valve 81 is spring-loaded to remain in low speed unless hydraulic control pressure is supplied to it by valve 80. Valve 80 may be stable in either position.

For lowering the load by motor 17, lever 72 is moved to connect lines 73 and 74 oppositely than for raising so that pressure fluid is supplied to line 74. After flowing through the motor 17 in the reverse direction, it must pass through safety valve 77. However, so long as the pressure for load lowering its maintained, pilot section 83 of safety valve 77 opens this valve as required. The pressure for the pilot section is derived from line 74, through pilot line 84.

A shuttle valve 86 supplies pressure (through multivalve 85 when provided) to tube 43 of FIG. 1. Valve 86 derives this pressure either from line 73 or from line 74, without permitting any cross connection between the lines 73 and 74.

To the extent as so far described, the hydraulic system may be considered largely conventional.

Most of the remainder of the hydraulic system shown in FIG. 6 is not needed unless free fall is desired by a customer. This may be rare, because the two-speed winch is popular enough not to leave very frequent call for free fall. Nevertheless, the ability to provide free fall when it is desired is an important advantage of the winch drive illustrated in FIGS. 1 to 5.

Even when free fall is provided, there will be long periods when it is not used, and a separate valve having a control lever is preferred for free fall control. Valve 87 is one example of such a valve. When it is in its "off" or "normal operation" position to which it may be spring-loaded, it connects its pressure supply line 88 with a return line R to tank. To cause free fall, valve 87 is moved by hand lever 111 to another position. Its pressure supply line 88 from pump $P_1$ is then connected only to output line 89, which leads both to tube 43 for actuating the release of the fail-safe brake, and to tube 52 for disengaging the dog clutch 16. There is thus no substantial restraint on the drum 10 and its line may be pulled out fast by the load on it, for "free fall". A feature of the present invention is that the gearing for the drive of the drum 10 remains in mesh, and although it may be quite high ratio gearing for enormous pull, its friction is so low that it does not offer excessive resistance to free fall.

When the free fall control valve 87 is shifted in the opposite direction, it connects hydraulic pressure line 88 only to line 90 which leads to tube 43 to keep the fail-safe brake 41 released, to tube 52 to keep dog clutch 16 disengaged, and to tube 63 to apply free fall brake 61 and stop free fall.

For anyone preferring to control the amount of hydraulic pressure that is applied to free fall brake 61, control means such as are used for vehicle brakes may be provided.

Figure 7:
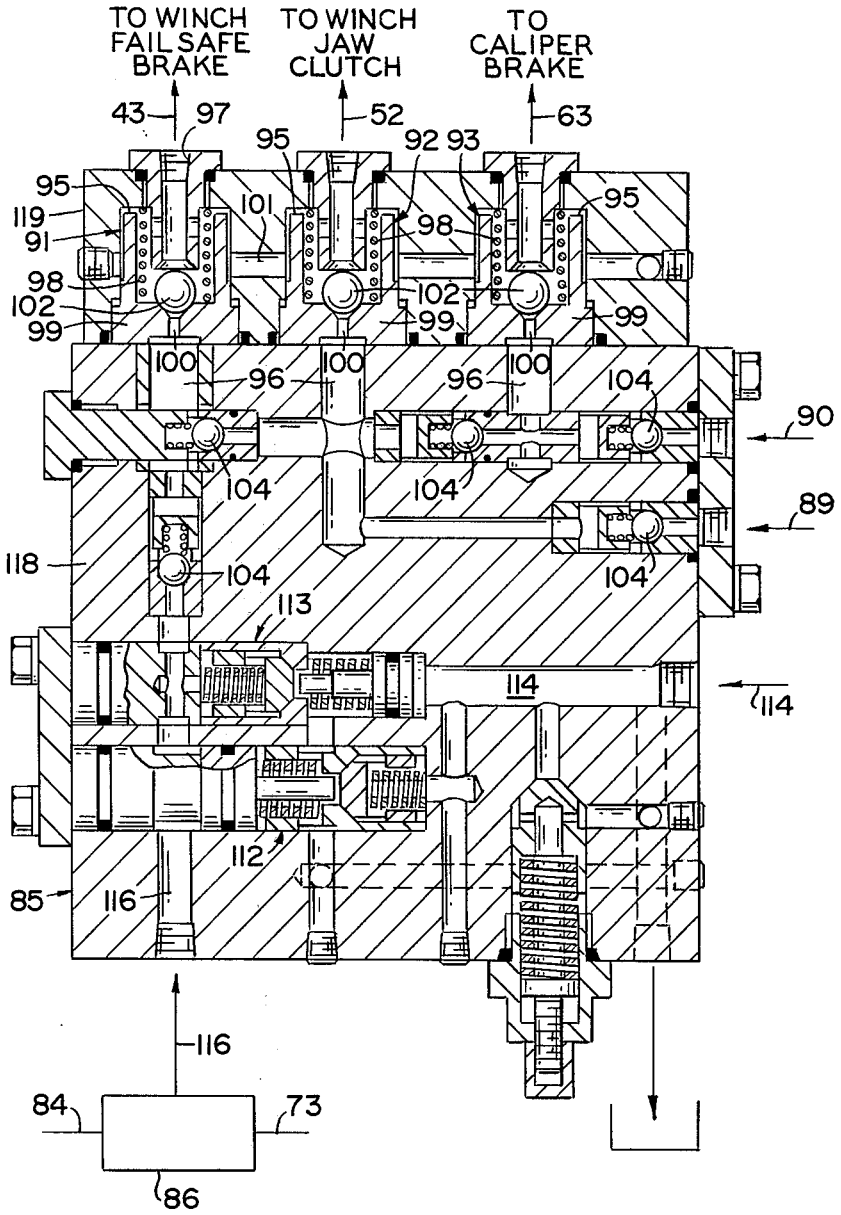
FIG. 7 is a sectional view through a newly designed multiple-valve block.

The three expansion chambers 44, 56 and 64 require substantial venting (i.e., discharge to return-to-tank) to allow return of their pistons. A type of valve especially designed for such venting is used as valves 91, 92 and 93 and may be described with reference to valve 91. This valve, which may be called a shuttle valve, or automatic discharge valve, is shown in FIG. 7, as part of multi-valve block 85, but it could be a separate valve. This valve has a supply port 96 and an output port 97. The line that is the source of pressure when pressure is to be passed-on through output port 97 leads to supply or inflow port 96. Spring 98 biases piston 99 toward the position shown. Output port 97 then communicates with return port 101 for return to the tank so as to vent the controlled line 43 connected to output port 97. When pressure is supplied through inflow port 96, it overpowers spring 98 and thrusts piston 99 to its forward position at which its annular tip 95 seats and obstructs the path to return port 101, so that the supplied pressure, passing through the small bore 100 in the piston 99, is passed through output port 97 to the controlled line 43, 52 or 63. Although the inside of piston 99 may then be subjected to the full supply pressure, the piston remains actuated because it is a differential piston. Its effective face toward port 97, especially when seated at 95, is smaller than its effective face toward port 96. In case there is any reason to prevent back flow through supply port 96, a ball valve 102 may be provided.

Whenever an element may be actuated by pressure from any one of a plurality of lines, all such lines are provided with check valves 104, as shown.

It might seem that check valves 104 would trap hydraulic fluid in valve 91 and maintain the equalized pressure on both sides of its piston which (as explained shortly above) maintains that piston actuated. However, the nature of the closing of the piston tip against its seat is such that seepage is inevitable. Also, the O-ring shown around piston 99 preferably does not seal against it. The slightest seepage of liquid when no more is being supplied relieves the hydraulic pressure so that spring 98 can unseat the piston 99 at its tip 95 and permit copious flow to return port 101. A minute radial groove could be purposely provided in the tip 95 of piston 99 to impair its seal enough to ensure the needed seepage. Pumps $P_1$ and $P_2$ may be small pumps, such as 5 GPM, but this is more than enough to make the seepage negligible when the 5 GPM is supplied to inflow port 96, or to all three such ports.

Because an operator might have one hand on each of the levers for valves 71 and 87, it is preferred to provide cross neutralization for these valves, so that when either has been operated, the other will have no effect, if operated.

When valve 87 is operated, it opens the dog clutch, thereby neutralizing the motor-controlling effect of valve 71 to the extent that it can only make the motor 17 spin idly.

Valve 112 provides the neutralization of valve 87 when valve 71 is operated first. It is shown by a symbol in FIG. 6 and more in detail in FIG. 7. It is normally closed and pilot-operated to open. Although structurally a check valve, it is never opened except by pilot pressure, and flow is then in the normally-blocked direction. As seen best in FIG. 6, when valve 71 is actuated first, it supplies pressure through shuttle valve 86 to line 116 (including the connected passage in block 85) to serve as the pilot pressure for valve 112, opening it so that there is free flow from pump line 88 through connecting line 114 and valve 112 to the tank. There is thus no longer sufficient pressure in line 88 to actuate anything if valve 87 is operated. To prevent this bypassing-to-tank of line 88 when valve 87 is the first operated, valve 113 is provided. When valve 87 is actuated, it closes its bypass-to-tank for line 88 so that line 88 becomes pressurized. Its extension 114 then delivers pilot pressure to valve 113 opening it to serve as a bypass-to-tank for line 116 so that line 116 can no longer have enough pressure to open valve 112.

The details of multi-valve block 85 are believed to be sufficiently clear from FIG. 7 not to need description. As seen, it can be made mainly from two machined block portions, 118 and 119. Most of its inserts are sealed by O-rings, and O-rings also seal the passage junctions between block parts 118 and 119. Other elements or connections can be included in block 85 if desired. For example, if main pump P had drain ports, connecting them to a return-to-tank passage in block 85 may be convenient.

If deemed more safe, valve 87 can move in one direction from its normal extreme position, to which it would be spring-biased, through its center position for stopping free fall, to its other-extreme free fall position. In that event it even could have a jogged guide to prevent its inadvertent movement from free fall to normal. This would be desirable if the stopping power of the fail-safe brake would be too great for safe stopping of free fall.

ACHIEVEMENT

Although the compound planetary gearing chosen according to this invention may have known advantages, it is exceptionally valuable for driving a crane winch. Although perhaps its outstanding advantage is in making free fall possible in spite of very high ratio gearing, without disengaging the gears, its less glamourous advantages may be even more important. One advantage is compactness, which is especially suitable for winch drives because the entire gearing can lie within the drum, in spite of giving high ratio gearing, and even leave room within the drum for other parts such as a dog clutch. The same low friction characteristic that permits free fall is advantageous without free fall. With a given hydraulic source lifting a load at a given speed, energy not spent on friction, can hoist a greater load. Reduced friction also means less wear, and less of the expensive ruggedness that is needed to withstand wear.

I claim:

1. A winch including a drum for a hoist line; single-stage high ratio and high efficiency compound planetary gearing within the drum; a drive shaft, and a sun gear locked to the drive shaft and driving the planetary gearing; fail-safe braking applied to said sun gear and shaft characterized by being spring-biased to lock the shaft and gearing and through them the drum even when no other braking is activated; a free fall clutch for disconnecting said shaft from a driving motor to permit said sun gear and shaft to spin freely for free fall when the fail-safe brake is disengaged; free-fall braking means including a rotor rotating with the drum and a separate free fall brake, accessible for servicing, for engaging said rotor for stopping said drum to stop free fall.

2. A winch including a drum for a hoist line; single-stage high ratio and high efficiency compound planetary gearing within the drum; a drive shaft, and a sun gear locked to the drive shaft and driving the planetary gearing; fail-safe braking applied to said sun gear and shaft characterized by being spring-biased to lock the shaft and gearing and through them the drum even when no other braking is activated; a free fall clutch for disconnecting said shaft from a driving motor to permit said sun gear and shaft to spin freely for free fall when the fail safe brake is disengaged; separate free-fall braking means including a rotor rotating with the drum and a free fall brake, accessible for servicing, for engaging said rotor for stopping said drum to stop free fall; each of said brakes and said clutch being actuated in one direction by a movable element of an expansion chamber; means for supplying pressured fluid to each expansion chamber and for discontinuing the supply without directly venting it; and separate means for venting each chamber in response to the discontinuance of supply thereto of the pressured fluid.

3. Hydraulic winch apparatus for cranes and the like, including a drum, a hydraulic motor for operating the drum; single-stage compound planetary gearing through which the motor drives the drum; a hydraulically operated clutch between the motor and gearing; a fail-safe brake operable on the motor side of the gearing; a free fall brake associated directly with the drum; a main control valve operator-controlled for supplying pressured liquid to the motor for raising or lowering a load by driving the drum with the clutch engaged; a free fall control valve operator-controlled from a normal-operation position to a free fall position and to a stop free fall position; means effective when the free fall control valve is in the free fall position to disengage the clutch and fail-safe brake, and when the free fall control is in the stop free fall position to disengage the clutch and fail-safe brake and apply the free fall brake; and cross-neutralizing means effective when either of the operator-controlled valves is operated first for neutralizing the other so that the other cannot be effectively operated.

4. A winch including a drum for a hoist line; a drive shaft concentric with the drum; a sun gear locked to the drive shaft; single-stage high ratio and high efficiency compound planetary gearing within the drum, driven by the sun gear and driving the drum; said gearing including a fixed internal gear, an internal gear on the drum, and two coaxial planetary pinions locked together and orbiting together but of different pitch diameters, and having exactly three points of meshing with gears of said gearing, one point being meshing of one pinion with the fixed internal gear, another point being meshing of the other pinion with the internal gear on the drum, and the third point being meshing of one of the pinions with the sun gear; a fail-safe brake spring-biased for engagement and acting to prevent rotation of the drive shaft and through the drive shaft and gearing to prevent rotation of the drum in a load lowering direction; and means actuated by fluid subject to manual control for fully releasing said brake whereby it offers no resistance to load lowering while the gearing remains in mesh and fully operative between the drum and the drive shaft.

5. A winch according to claim 4 including means for freeing the drive shaft so that it may be rotated freely by the drum during free fall.

6. A winch including a drum for a hoist line; a drive shaft concentric with the drum; a sun gear locked to the drive shaft; single-stage high ratio and high efficiency compound planetary gearing within the drum, driven by the sun gear and driving the drum; said gearing including a fixed internal gear, an internal gear on the drum, and two coaxial planetary pinions locked together and orbiting together but of different pitch diameters, and having exactly three points of meshing with gears of said gearing, one point being meshing of one pinion with the fixed internal gear, another point being meshing of the other pinion with the internal gear on the drum, and the third point being meshing of one of the pinions with the sun gear; a fail-safe brake spring-biased for engagement and acting to prevent rotation of the drive shaft and through the drive shaft and gearing to prevent rotation of the drum in a load lowering direction; and means actuated by fluid subject to manual control for fully releasing said brake whereby it offers no resistance to load lowering while the gearing remains in mesh and fully operative between the drum and drive shaft; the winch having free fall facilities including means for freeing the drive shaft from speed limitation to the driven speed of a driving motor to permit said sun gear and shaft to spin freely for free fall when all braking is disengaged.

* * * * *